US007287785B2

(12) United States Patent
Schupp et al.

(10) Patent No.: US 7,287,785 B2
(45) Date of Patent: Oct. 30, 2007

(54) SIDE DOOR LATCH PAWL FUNCTION AUGMENTATION

(75) Inventors: Michael W. Schupp, Farmington Hills, MI (US); John G. Zeabari, Highland, MI (US)

(73) Assignee: Intier Automotive Closures Inc., Newmarket, Ontario (CA)

( * ) Notice: Subject to any disclaimer, the term of this patent is extended or adjusted under 35 U.S.C. 154(b) by 99 days.

(21) Appl. No.: 11/098,346

(22) Filed: Apr. 4, 2005

(65) Prior Publication Data

US 2005/0218663 A1 Oct. 6, 2005

(51) Int. Cl.
*E05C 3/06* (2006.01)
*E05C 3/00* (2006.01)

(52) U.S. Cl. ..... 292/216; 292/201; 292/251.5; 292/DIG. 23; 292/DIG. 65; 307/10.1; 70/264

(58) Field of Classification Search ..... 292/201, 292/216, 251.5, DIG. 23, DIG. 65; 70/257, 70/264, 277; 307/10.1
See application file for complete search history.

(56) References Cited

U.S. PATENT DOCUMENTS 3,386,761 A * 6/1968 Johnstone et al. ..... 292/201
3,612,207 A 10/1971 Cabanes et al.
3,620,560 A * 11/1971 Peters ..... 292/201
5,288,037 A * 2/1994 Derrien ..... 244/102 SL
5,323,628 A * 6/1994 Mori et al. ..... 68/12.26
5,497,641 A 3/1996 Linde et al.
5,802,894 A 9/1998 Jahrsetz et al.
6,439,623 B1 8/2002 Lohfeld et al.
6,554,328 B2 4/2003 Cetnar
6,648,379 B1 11/2003 Kordowski et al.
6,652,009 B2 11/2003 Fisher et al.
6,786,070 B1 9/2004 Dimig et al.
6,811,118 B2 * 11/2004 Collet et al. ..... 244/102 SL
6,824,176 B2 11/2004 Spurr et al.
2005/0046200 A1 * 3/2005 Dominique ..... 292/216

* cited by examiner

*Primary Examiner*—Carlos Lugo
(74) *Attorney, Agent, or Firm*—Clark Hill PLC

(57) ABSTRACT

A door latch assembly of a motor vehicle is provided for selectively engaging a striker between latched and unlatched positions. The door latch assembly includes a ratchet for receiving and engaging the striker. The door latch assembly also includes a pawl movable between a locked position, in which the pawl abuts the ratchet into engagement with the striker, and an unlocked position, in which the pawl and the ratchet are spaced apart from one another so that the ratchet releases the striker. In addition, the door latch assembly includes an electromagnet disposed adjacent the pawl for generating a magnetic field to alter the force required to move the pawl out of the unlocked position and into the locked position.

15 Claims, 2 Drawing Sheets

SIDE DOOR LATCH PAWL FUNCTION AUGMENTATION

FIELD OF THE INVENTION

The invention relates to a side door latch for a motor vehicle. More particularly, the invention is related to a door latch assembly including an electromagnet for altering the force required to disengage a pawl of a side door latch from a ratchet thereof.

DESCRIPTION OF RELATED ART

A side door latch is typically mounted along a door of a motor vehicle to selectively engage a striker fixedly secured to a door opening formed in the motor vehicle. The side door latch includes a ratchet and a pawl. The ratchet is movable between a latched position, in which the ratchet retains the striker, and an unlatched position, in which the ratchet releases the striker. The pawl is movable between a locked position, in which the pawl engages the ratchet and holds it in the latched position, and a released position, in which the pawl disengages the ratchet so that the ratchet releases the striker in the unlatched position.

Upon exposure to high acceleration forces, e.g. forces created from a motor vehicle impact, the side door latch may inadvertently release the striker. More specifically, the high acceleration forces may cause the pawl to move from its locked position to its release position, causing the ratchet to move into its unlatched position and release the striker. Various mechanical devices, such as inertia catches, are well-known for preventing inadvertent release of the striker from the side door latch. But, these mechanical devices increase production cycle time and increase the overall weight of the motor vehicle.

SUMMARY OF THE INVENTION

It is desirable to provide a door latch assembly that is capable of selectively providing additional forces to retain a ratchet in a latched position engaging a striker.

According to one aspect of the invention, a door latch assembly of a motor vehicle is provided for selectively engaging a striker between latched and unlatched positions. The door latch assembly includes a ratchet for receiving and retaining the striker. The door latch assembly also includes a pawl movable between a locked position, in which the pawl forces the ratchet into engagement with the striker, and an unlocked position, in which the pawl and the ratchet are spaced apart from one another allowing the ratchet to release the striker. In addition, the door latch assembly includes an electromagnet disposed adjacent the pawl for generating a magnetic field to alter the force required to move the pawl out of the unlocked position and into the locked position.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
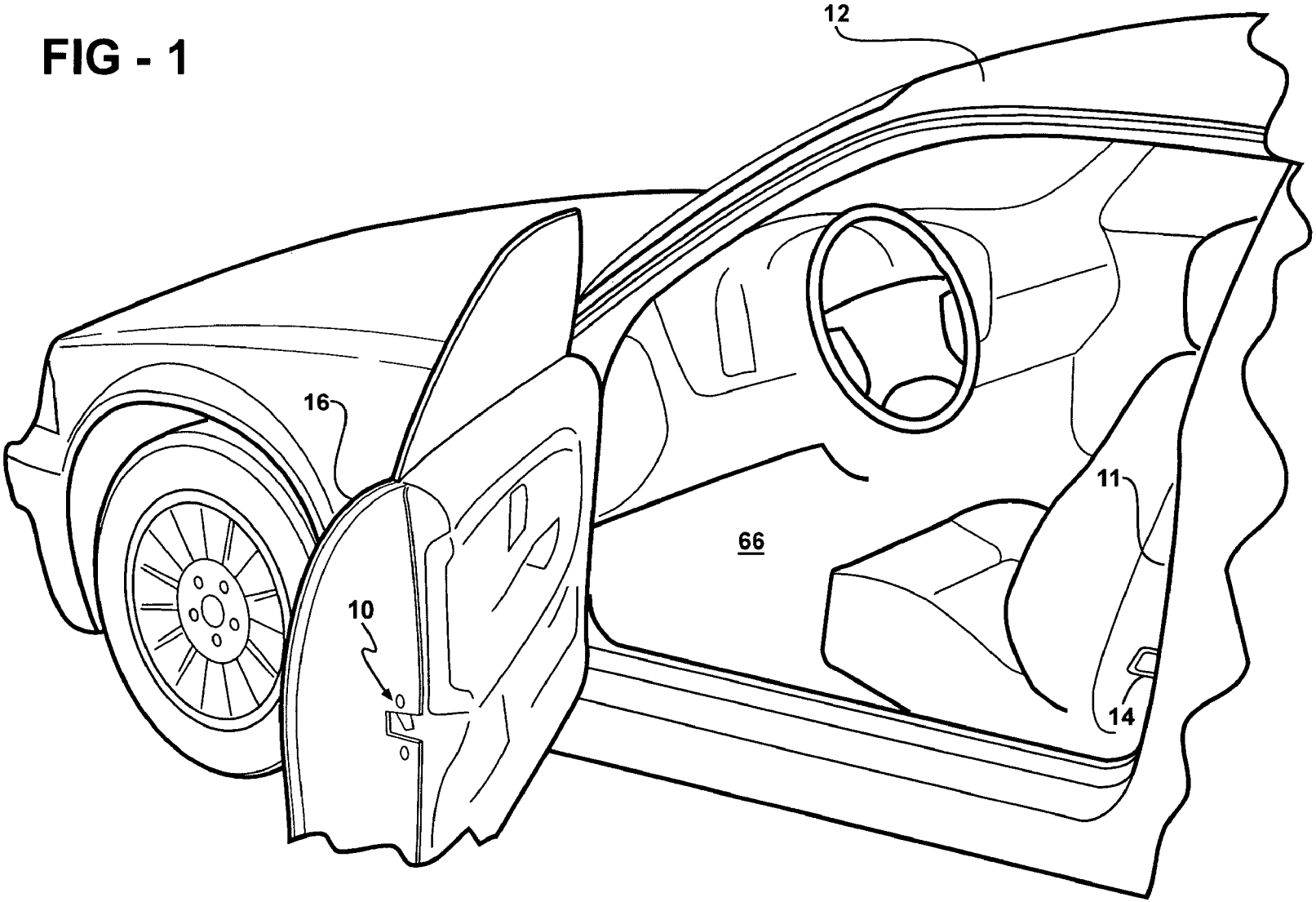
FIG. 1 is a fragmentary, perspective view of a motor vehicle including a side door latch for selectively engaging a striker between latched and unlatched positions.

Referring to FIG. 1, a door latch assembly, generally indicated at 10, is mounted along a door 16 of a motor vehicle 12. The door latch assembly 10 selectively engages a striker 14, which is fixedly mounted to a body 11 of the motor vehicle 12, when closing the door 16.

Figure 2:
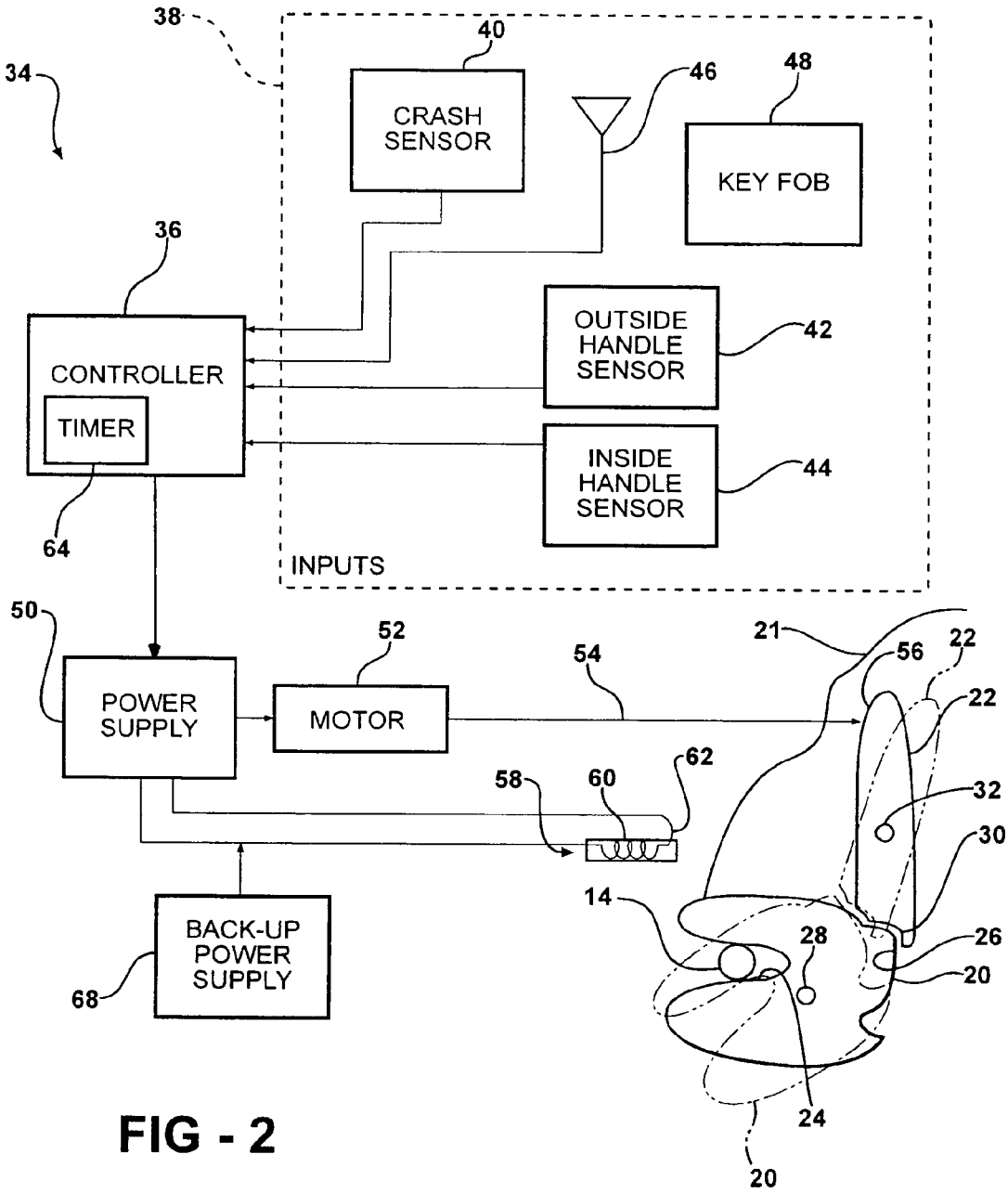
FIG. 2 is a schematic view of a door latch assembly according to the invention.

Referring to FIG. 2, the door latch assembly 10 includes a ratchet 20 and a pawl 22, both of which are rotatably mounted to a base 21 of the door latch assembly 10. The ratchet 20 includes an opening 24 for receiving and retaining the striker 14 therewithin, and a pawl engagement portion 26. The ratchet 20 is rotatably mounted to a first pin 28 for movement between a latched position and an unlatched position, as shown in FIG. 2. When the ratchet 20 is in the latched position, the striker 14 is retained within the opening 24 to keep the door 16 closed.

The pawl 22 includes a detent 30. The pawl 22 is rotatably mounted to a second pin 32 and is movable between a locked position and a release position, as shown in FIG. 2. When the pawl 22 is in the locked position, the detent 30 abuts the pawl engagement portion 26 to hold the ratchet 20 in the latched position. When the pawl 22 moves away from the locked position, the detent 30 disengages from the pawl engagement portion 26, and the ratchet 20 is free to rotate about the first pin 28. As a result, the ratchet 20 releases the striker 14 to enable opening of the door 16.

The door latch assembly 10 also includes a control circuit 34 for moving the pawl 22 with respect to the ratchet 20. The control circuit 34 includes a controller 36 that receives signals from various inputs 38. The inputs 38 are generated from a crash sensor 40, an outside handle sensor 42, an inside handle sensor 44, and an antenna 46 that receives a signal from an electronic key fob 48 that is used for a remote keyless entry system. The crash sensor 40 and the sensors associated with the outside 42 and inside 44 handles, as well as the signal generated by the electronic key fob 48 are all known in the art.

The output of the controller 36 is received as an input to a power supply 50. The power supply 50 has two outputs. A first output is used to power a motor 52. The motor 52 has an output of a mechanical force that is graphically represented by an arrow 54. This output force 54 is a mechanical force that moves a force receiving end 56 of the pawl 22 such that the detent 30 moves into and out of engagement with the ratchet 20. The power supply 50 would power the motor 52 depending on whether the controller 36 receives a signal from the outside handle sensor 42, the inside handle sensor 44 or the electronic key fob 48.

A second output of the power supply 50 is electrically coupled with an electromagnet 58. The electromagnet 58 includes a ferromagnetic core 60 that is wrapped by a conductive wire 62 wherein both ends of the conductive wire 62 are electrically connected to the power supply 50 to receive the output therefrom. When a signal is received from the outside handle sensor 42, the inside handle sensor 44, or the electronic key fob 48, the electromagnet 58 generates a magnetic field which repels the pawl 22 from the ratchet 20. This repelling force reduces the requirements of the output force 54 by the motor 52 to unlatch the ratchet 20 allowing the striker 14 to disengage therefrom to allow the door 16 to be opened.

When the controller 36 receives a signal from the crash sensor 40, the power supply 50 generates a current in the conductive wire 62 opposite that which it normally does when it receives a signal from the handle sensors 42, 44 or the electronic key fob 48. When the controller 36 receives this signal from the crash sensor 40, a magnetic field is generated in a direction opposite that which was discussed above. Therefore, the electromagnet 58 attracts the pawl 22 in toward the ratchet 20, making it more difficult for the ratchet 20 to move in a direction that would release the striker 14 and the door 16. This attraction force makes it more difficult in a crash situation for the pawl 22 to inadvertently release the ratchet 20.

The controller 36 includes a timer 64 that is used in the situation where a crash sensor 40 generates a signal, i.e., when the motor vehicle 12 crashes. The timer 64 generates the time in which the power supply 50 generates the attractive force through the electromagnet 58 to maintain the pawl 22 in positive engagement with the ratchet 20. When a time period is measured by the timer 64, the controller 36 reverses the signal to the power supply 50, which, in turn, changes the direction of the current through the conductive wire 62 to change the magnetic field and its force on the pawl 22. More specifically, the controller 36 changes the magnetic field generated by the electromagnet 58 repelling the pawl 22 from the ratchet 20 allowing the striker 14 to be released in an easier fashion allowing quicker ingress and egress from the passenger compartment 66 of the motor vehicle.

A backup power supply 68 is electrically connected to the conductive wire 62. When the backup power supply 68 senses that the power supply 50 is offline or in some way disconnected from the electromagnet 58, the backup power supply 68 generates the force necessary to operate the electromagnet 58.

The invention has been described in an illustrative manner, and it is to be understood that the terminology, which has been used, is intended to be in the nature of words of description rather than of limitation. Many modifications and variations of the present invention are possible in light of the above teachings. It is, therefore, to be understood that within the scope of the appended claims, the invention may be practiced other than as specifically described.

What is claimed:

1. A door latch assembly of a motor vehicle for selectively engaging a striker between latched and unlatched positions, said door latch assembly comprising:

a ratchet for receiving and engaging the striker;

a pawl movable between a locked position, in which said pawl engages said ratchet into position for retaining the striker, and an unlocked position, in which said pawl disengages said ratchet for allowing said ratchet to release the striker;

an electromagnet disposed adjacent said pawl;

a power supply operatively connected to said electromagnet to generate a first electrical current and a second electrical current opposite said first electrical current; and a controller operatively connected to said power supply for controlling activation of said first and second electrical currents wherein said electromagnet selectively generates a first magnetic field to attract said pawl in response to said first electrical current and a second magnetic field opposite said first magnetic field to repel said pawl in response to said second electrical current.

2. A door latch assembly as set forth in claim 1 wherein said electromagnet includes a ferromagnetic core.

3. A door latch assembly as set forth in claim 2 wherein said electromagnet includes a conductive wire wrapped around said ferromagnetic core and electrically connected to said power supply.

4. A door latch assembly as set forth in claim 3 including a sensor operatively connected to said controller for sensing an impact of the motor vehicle.

5. A door latch assembly as set forth in claim 4 wherein said electromagnet generates said first magnetic field to attract said pawl in response to said sensor sensing the impact of the motor vehicle in order to increase the force required to move said pawl between said locked and unlocked positions.

6. A door latch assembly as set forth in claim 5 wherein said controller includes a timer for measuring a predetermined time period during which said power supply provides said first electrical current and said electromagnet generates said first magnetic field to attract said pawl before said controller changes and sends a signal to said power supply whereby said power supply then provides said second electrical current and said electromagnet generates said second magnetic field to repel said pawl thereby disengaging said pawl from said ratchet for release of the striker.

7. A door latch assembly as set forth in claim 3 including a backup power supply electrically connected to said conductive wire for providing said first and second electrical currents required to operate said electromagnet in the event of failure of said power supply.

8. A door latch assembly as set forth in claim 3 wherein said electromagnet reduces the force required to actuate said door latch assembly during normal operation.

9. A door latch assembly of a motor vehicle for selectively engaging a striker between latched and unlatched positions, said door latch assembly comprising:

a ratchet for receiving and engaging the striker;

a pawl movable between a locked position, in which said pawl engages said ratchet into position for retaining the striker, and an unlocked position, in which said pawl disengages said ratchet for allowing said ratchet to release the striker;

a motor operatively connected to said pawl for generating an output force upon said pawl to actuate said door latch assembly during normal operation;

an electromagnet disposed adjacent said pawl; and a sensor operatively connected to said controller for sensing an impact of the motor vehicle;

wherein said electromagnet generates a first magnetic field to attract said pawl in response to said sensor sensing the impact of the motor vehicle in order to increase the force required to move said pawl between said locked and unlocked positions.

10. A door latch assembly as set forth in claim 9 including a power supply operatively connected to said electromagnet for providing a first electrical current thereto.

11. A door latch assembly as set forth in claim 10 including a controller operatively connected to said power supply for controlling activation of said first electrical current.

12. A door latch assembly as set forth in claim 11 wherein said electromagnet includes a ferromagnetic core.

13. A door latch assembly as set forth in claim 12 wherein said electromagnet includes a conductive wire wrapped around said electromagnetic core and electrically connected to said power supply.

14. A door latch assembly as set forth in claim 13 wherein said controller includes a timer for measuring a predetermined time period during which said power supply provides said first electrical current and said electromagnet generates said first magnetic field to attract said pawl before said controller changes and sends a signal to said power supply whereby said power supply then provides a second electrical current opposite said first electrical current and said electromagnet generates a second magnetic field opposite said first magnetic field to repel said pawl in order to reduce the output force required by said motor to open said door latch assembly during normal operation.

15. A door latch assembly as set forth in claim 14 including a backup power supply electrically connected to said conductive wire for providing said first and second electrical currents required to operate said electromagnet in the event of failure of said power supply.

* * * * *